US006807756B2

(12) United States Patent
Gohre et al.

(10) Patent No.: US 6,807,756 B2
(45) Date of Patent: Oct. 26, 2004

(54) PULSED STEAM IRON

(75) Inventors: Ernst-Otto Gohre, Erbach (DE); Axel Wehrwein, Rossdorf (DE); Norbert Voss, Offenbach (DE)

(73) Assignee: ROWENTA Werke GmbH, Offenbah (DE)

( * ) Notice: Subject to any disclaimer, the term of this patent is extended or adjusted under 35 U.S.C. 154(b) by 0 days.

(21) Appl. No.: 10/469,120

(22) PCT Filed: Feb. 14, 2002

(86) PCT No.: PCT/IB02/00448

§ 371 (c)(1),
(2), (4) Date: Aug. 27, 2003

(87) PCT Pub. No.: WO02/068748

PCT Pub. Date: Sep. 6, 2002

(65) Prior Publication Data

US 2004/0128873 A1 Jul. 8, 2004

(30) Foreign Application Priority Data

Feb. 27, 2001 (FR) ..... 01/02676

(51) Int. Cl.[7] ..... D06F 75/18
(52) U.S. Cl. ..... 38/77.81; 38/77.82
(58) Field of Search ..... 38/74, 77.1, 77.3, 38/77.5, 77.7, 77.8, 77.81, 77.82, 77.83, 93; 219/254; 237/63, 67; 68/222

(56) References Cited

U.S. PATENT DOCUMENTS

| | | | | | |
|---|---|---|---|---|---|
| 2,596,684 | A | * | 5/1952 | Hedenkamp | 38/77.7 |
| 2,782,537 | A | | 2/1957 | Vera-Mege | |
| 3,002,302 | A | * | 10/1961 | Flowers | 38/77.5 |
| 3,703,043 | A | * | 11/1972 | Ogata et al. | 38/77.83 |
| 5,010,664 | A | * | 4/1991 | Sakano et al. | 38/77.7 |
| 5,430,963 | A | | 7/1995 | Kuo-Chu | |
| 5,638,622 | A | * | 6/1997 | Hohn | 38/77.5 |
| 6,745,504 | B2 | * | 6/2004 | Sastre et al. | 38/77.82 |

FOREIGN PATENT DOCUMENTS

| | | |
|---|---|---|
| FR | 2 626 901 | 8/1989 |
| JP | 01262899 | 10/1989 |

* cited by examiner

*Primary Examiner*—Ismael Izaguirre
(74) *Attorney, Agent, or Firm*—Browdy and Neimark, P.L.L.C.

(57) ABSTRACT

The invention relates to an iron (1) comprising a container of water (2) at atmospheric pressure. The water from the container flows through a nozzle between said container (2) and a heated and regulated steam chamber (5). An iron sole plate (3) forms the ironing surface and steam outlet holes (12) are arranged in said sole plate (3). The invention is characterized in that the iron (1) comprises means for creating a resonance or relaxation vibration in the water and steam circuit. The cyclic variation in the steam pressure is automatically maintained at an average pressure above that corresponding to the column of water available in the iron.

9 Claims, 6 Drawing Sheets

PULSED STEAM IRON

The present invention concerns steam irons where vaporization of water is quasi-instantaneous.

There are known steam irons generally comprising a water reservoir, a steam chamber heated to rapidly evaporate water that arrives therein in droplets from the reservoir, a heated soleplate having the ironing surface, steam outlet holes being arranged in the soleplate.

The simplest irons have a valve with a controllable flow rate through which the water drops from the reservoir into the steam chamber under the effect of gravity. The steam produced exits the iron toward the environment through channels and outlet holes constituting an escape circuit for the steam. But the steam occupies a large volume and travels through the escape circuit at an elevated velocity. As a result of load losses of this circuit, the pressure of the steam in the steam chamber rises. Moreover, when the steam iron is applied onto material being ironed, the outlet of the steam through the holes of the soleplate is opposed and the pressure in the steam chamber increases further.

This internal pressure in the steam chamber is opposed to the passage of water into the valve having an adjustable flow rate, which substantially decreases the following quantity of steam produced. The internal overpressure cannot exceed a value corresponding to the height of a column of water between the water outlet of the valve and the level of water in the reservoir, generally several centimeters. By this fact, the quantity of steam varies substantially during ironing, depending on the materials and the ironing support. The load losses being proportional to the square of the velocity of the steam in the circuit, the speed is limited, in particular the outlet speed through the holes of the soleplate, which can be a drawback to the penetration of the steam into the material. In addition, one cannot use the steam in a sprayer, which requires much too much pressure for its operation.

These drawbacks justify the use, in more elaborate irons, of a pump that forces the passage of water from the reservoir to the steam chamber, the pressure delivered by the pump being considerably greater than that which is generated by the load losses. But this solution increases the price of the iron because of the value of the pump, of its installation, and of its supply device if it is electric.

There are also known devices utilizing variations of the steam pressure in the steam chamber between periods when the iron is placed on the fabric and those where it is not, this in order to force the passage of water. Such a device is described, for example, in the patent FR2626901. But these devices are equally costly and delicate.

The patent JP01262899 describes an iron having an excess steam valve having a control shank that is driven by an electromagnet. The valve is actuated periodically in order to produce an excess of steam in a manner to clean the steam chamber. An overpressure is produced by the closing of the valve. But this device is not provided to continuously obtain powerful steam.

The steam can also be placed under elevated pressure, which resolves these problems. This is the case when the iron comprises—or is associated with—a steam generator having a closed boiler in which a mass of water boils slowly, but these systems have a high price.

The object of the invention herebelow is to reduce these drawbacks by proposing an economical iron in which the average pressure of the steam generated is sufficiently high to be free of the overpressure due to the ironing and/or to permit high output velocities of the steam and/or to permit the utilization of steam in a sprayer.

The object of the invention is achieved by a pressing iron having a water reservoir at atmospheric pressure, water from the reservoir flowing through an ajutage between this reservoir and a heated and regulated steam chamber, a soleplate having the ironing surface, steam outlet holes being arranged in the soleplate, noteworthy in that the iron comprises means placing the water and steam circuit in resonance or relaxation vibration, the cyclic variation of the steam pressure being automatically maintained at an average pressure above that corresponding to the column of water available in the iron.

FIG. 1 attached shows how one obtains in a surprising manner such a pressing iron. This figure is a graph of the mass of flow rate Q of steam in grams per minute as a function of the total cross-section S in square millimeters of the steam outlet orifices, for different passage diameters of the ajutage of a prototype. The diameters are indicated on each curve.

The prototype equipped at the beginning with an ajutage whose diameter was 0.95 mm had an initial steam outlet cross-section of 80 $mm^2$. Steam outlet holes were progressively eliminated in order to diminish the outlet cross-section. In this operation, until a cross-section of around 25 $mm^2$, the steam flow rate was seen to diminish slowly as expected. Then, when continuing the reduction, the iron produced in a surprising manner more and more steam up to 24 grams per minute with a steam outlet cross-section of only around 10 $mm^2$ and with an elevated outlet velocity. Simultaneously it was noted that the iron emitted a noise and that the average pressure in the steam chamber increased in a very substantial manner to greatly exceed the value corresponding to the height of the water column feeding the ajutage. It was noted with satisfaction that the steam then had a high velocity and a good effect of penetration into the material being ironed, without the application of the iron onto the material substantially diminishing the steam flow rate. It was noted that the pressure varied in a periodic manner. There were also noted reversals in the flow of the steam through the ajutage. The steam recondenses quickly in the water reservoir while provoking small implosions at a rapid cadence.

The phenomenon is not clearly explainable. In part, one can think that the steam chamber behaves with the outlet holes like a Helmholtz resonant cavity that would be excited by the vaporization of the water. In part, one can think that the steam implosions in the reservoir just above the valve propel the water with force into the chamber as is done in a pump. Since the steam chamber is a cavity which is not designed to have a low resonant frequency from the acoustic point of view, one can think that the phenomena combine and that when enough energy can be maintained in the resonator thus constituted, it oscillates while generating substantial overpressures that lead to an increased average pressure.

This is obtained when the steam outlet passage is correctly adjusted with the passage in the ajutage. With respect to known irons, it is necessary to substantially reduce the steam outlet and to increase the passage in the ajutage which, without the effect previously described, would have caused a fear that the steam overpressures due to the abundance of water would impede the operation.

The overpressure is obtained for a value of the steam outlet cross-section below a critical value. For greater outlet cross-sections close to this critical value, the onset of the mode of operation described is obtained by a shaking or abrupt opening of the ajutage. The operation can then present an instability which one can attempt to explain by an excessive loss of energy through the outlet holes, or by a great difficulty in transforming the pressure energy into sufficient kinetic energy. This energy is used normally to create a temporary pressure drop in the chamber and to aspirate water through the ajutage.

On FIG. 1 there are traced different curves of a prototype relative to ajutages whose passage diameter is different. The zone where the desired mode of operation is stable and begins spontaneously is limited toward the right by a curve A in dashed lines. This curve represents solution of a function f(S,Q)=0 that can be interpolated by a polynomial in the useful zone. By way of example, in the particular case of the prototype of FIG. 1 this function is written:

$$F(S,Q)=0.00027Q^3-0.035Q^2+1.258Q-S+8.18$$

With S expressed in square millimeters and Q in grams of steam produced per minute. The function F(S,Q) is zero for the points selected on the curve in dashed lines, positive if one selects a point M(S1,Q1) of operation that is stable and negative if the operation is unstable.

Preferably, the passages in the steam outlet holes and the diameter of the ajutage are adjusted in such a manner that the function $F(S,Q)=m10^{-4}Q^3-n10^{-2}Q^2+pQ-S+q$ is positive, in which Q is the mass flow rate of the steam (in g/min), S is the total cross-section of the orifices (in $mm^2$).

As concerns the prototype as described, with a predetermined type of arrangement and soleplate m is comprised between 1.5 and 3.5, preferably 2.5 n is comprised between 2 and 4.5, preferably 3.5 p is comprised between 1 and 2, preferably 1.25 q is comprised between 7 and 10, preferably 8.

However, the parameters vary with the structure of the iron and other ranges of values should be calculated to faithfully represent the behavior of other forms of construction.

Thus, the passages in the holes would be adjusted to be in the zone where the described function F(S,Q) is positive, i.e. situated to the left of the dashed line in the particular case of FIG. 1. One can not only adjust the cross-section of the passages but also their length in order to adjust the inertia effects of the steam circulating in these passages at high velocity.

Preferably, the ajutage is constituted by the passage in an adjustable flow rate valve.

The cross-section of the steam outlet is chosen to be suitable for a large range of openings of the valve so as to maintain a flow rate regulation that is easily possible in the described operation mode.

In a second version, the iron has a one-way valve between the reservoir and the steam chamber.

A water temperature that is too high in the reservoir interferes with a good operation of the oscillations. The one-way valve has the advantage of preventing return of steam into the water reservoir, and thus its slow heating.

The valve and the regulateable valve can advantageously be combined to only make one subassembly. In this version, the operation initially seemed much more critical with known steam chambers and steam circuits. In effect, the one-way valve suppresses the small implosions described above.

Usefully, the steam circuit has elongated passages where the steam circulates at high velocity that constitute with the valve and the steam chamber a stable oscillating steam circuit.

There is thus found the operating stability even at modest steam flow rates. The steam is constrained, before escaping, to flow at high velocity through one or more passages that are relatively long and of small cross-section with respect to known steam circuits. By this fact, a large mass of steam is placed in movement in the passages during vaporization and acquires kinetic energy thus transforming the pressure energy generated in the steam chamber. When the vaporization of the water introduced into the chamber terminates, this kinetic energy contributes to emptying the chamber of its remaining steam during a sufficient time period, provoking the opening of the valve, a new admission of water, a new vaporization, and the cycle recommences. The operating frequency is not equal to the acoustic resonant frequency of the steam circuit since the high pressure lasts as long as the water admitted abruptly is not completely evaporated. Also, it is sufficient that the circuit have enough energy to open the valve at the end of evaporation for the system to function.

There is found an operating characteristic similar to that described in FIG. 1 if along the abscissa section S is replaced by a product comprising the cross-section and the reciprocal of the length of the outlet circuit. The assembly can then be adjusted to obtain spontaneous and stable oscillations.

In a variant of construction utilizing a valve, one finds a stable oscillatory operation by substantially increasing the dimensions of the orifice to compensate for the absence of small implosions, and by utilizing a very light valve, in series with the droplet supply, without for that matter modifying the general conventional design of the steam circuit of the soleplate. In this pulsating regime, the flow rate obtained is substantial, advantageous for the ironing of difficult items.

Usefully, the droplet supply followed by a valve has a module closing a large passage intended to allow a large flow of water to pass more rapidly and pierced by the orifice properly called the droplet supply. The orifice is opened progressively by a needle shaft in a first part of its control travel and larger supplies of water and steam are obtained in a second part of the path of the shaft where the module is progressively lifted.

In the absence of other modifications, the presence of the valve increases the curvature toward the left and down of a curve A comparable to that visible in FIG. 1, and reduces the flow rate for an equal orifice cross-section and steam outlet, in a manner such that the operation at a low flow rate Q does not permit the automatic triggering of the oscillations. The presence of the valve thus requires larger openings for the same flow rate than the first version described. It also displaces the upper part of the stability curve A to the right in the diagram. The stability is improved by the large orifice openings and the high flow rates, which one can explain by the absence of a return flow and thus of energy losses in the reservoir. The steam outlet cross-section S can be greater.

When the needle progressively disengages from the orifice, a steam flow rate Q that is relatively low, but sufficient for ironing of easily ironed items is obtained. The steam produced in small quantities is incapable of raising the pressure, of closing the valve and of causing the iron to oscillate. When the opening of the orifice is increased, for a constant outlet cross-section SO, the operating point is displaced into the zone where the steam spontaneously produces the oscillations previously described. Water admitted rapidly into the chamber produces a blast of steam that is partially retained by the calibrated outlet, the pressure increases while closing the water admission valve, the vaporization continues at high pressure until exhaustion of the quantity of water admitted and evacuation of the steam, after which the valve opens and the cycle recommences.

This oscillatory regime assures a flow rate and a steam pressure that are substantial and effective to iron difficult items. The user of the iron thus has available two operating regimes of the iron appropriate for different ironing difficulties.

In a third version of the invention, the pressing iron comprises a valve having a fixed passage acting as the ajutage between the reservoir and the steam chamber.

This version operates like the preceding, but the steam flow rate is limited by the steam outlet circuit.

Preferably the pressing iron has in addition a valve for regulating the flow rate of steam situated in the steam circuit.

The flow rate of steam is limited by acting on the steam circuit rather than on the water circuit as in the second version. Moreover, the functioning of the oscillations is the same as in the second version.

The invention will be better understood from a reading of the examples herebelow and of the attached drawings.

Figure 4:
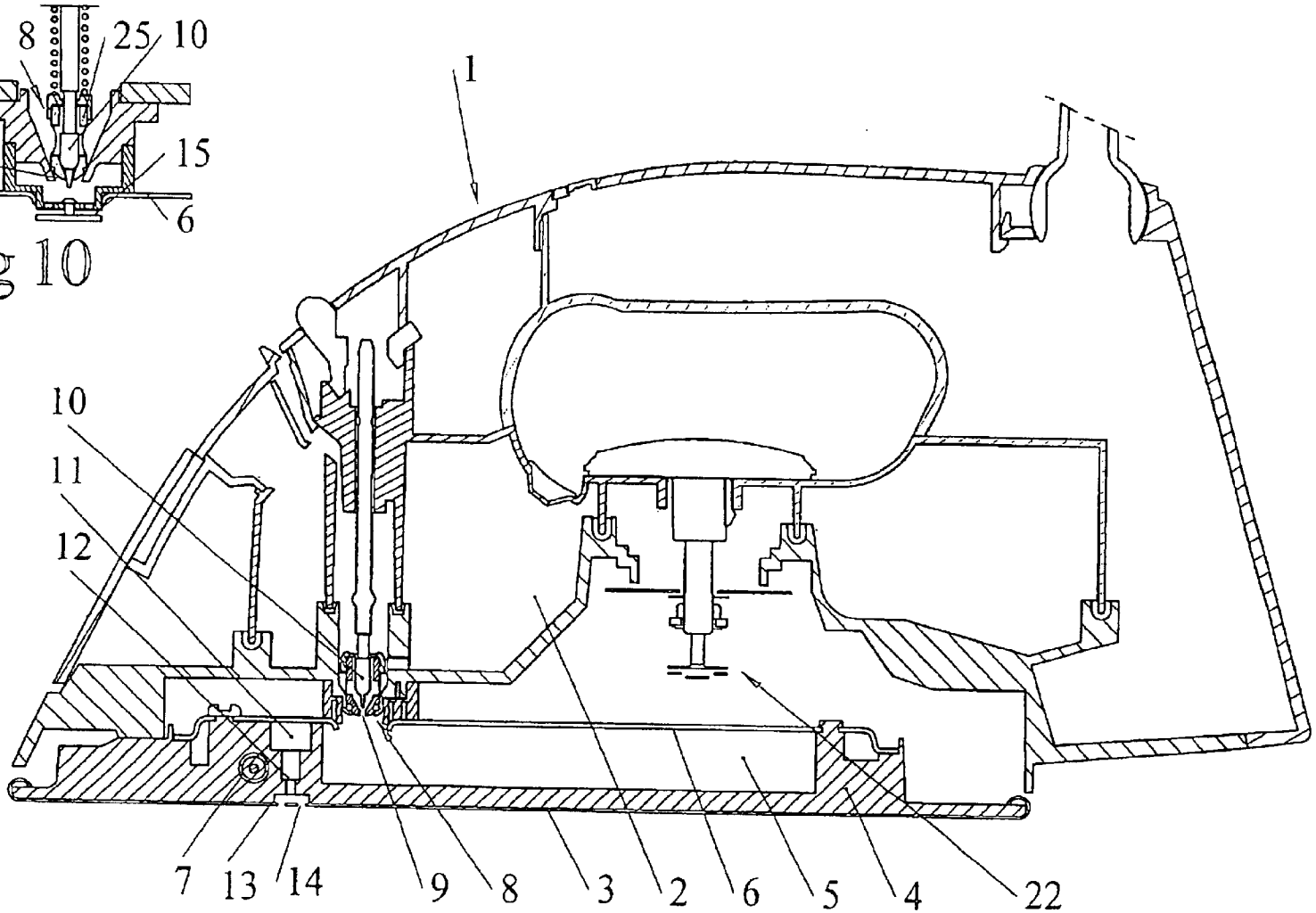
FIG. 4 is a longitudinal cross-sectional view of an iron according to a first version of the invention.

In a first version of the invention represented in FIG. 4, iron 1 has a water reservoir 2, a soleplate 3 in thermal communication with a heating body 4 including a steam chamber 5 enclosed by a plate 6 and provided with a heating element 7. Body 4 is regulated in temperature by a thermostat 22. A droplet device 8 provides a water passage from reservoir 2 toward steam chamber 5. The droplet device has an orifice 9 whose cross-section can be reduced by a needle 10. Steam produced instantaneously in steam chamber 5 is collected by passages or channels 11. It escapes into the atmosphere through a calibrated passage or passages 12. Preferably, the steam is then distributed under soleplate 3 by a distribution chamber 13 from which it escapes through holes 14 of the soleplate toward the fabric to be ironed.

Figure 1:
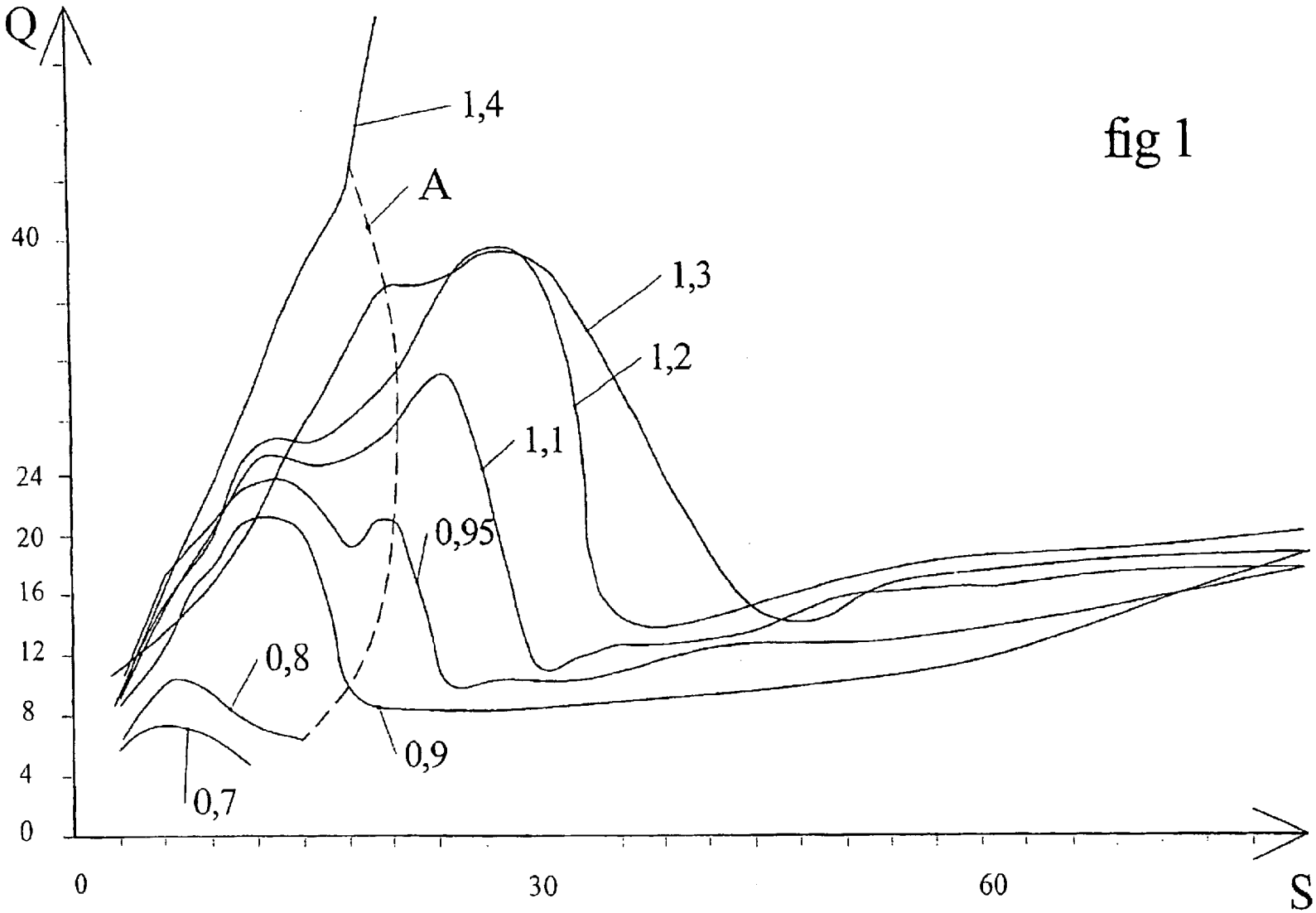
FIG. 1 is, as has already been seen, a diagram of the characteristic curves of the mass flow of steam of an iron according to the invention as a function of the steam outlet.

Referring to FIG. 1 corresponding to the prototype, it is noted that by sufficiently reducing the cross-section S of orifices 12, one obtains operating regimes that comprise a pulsating component and correspond at the same time to maximums of steam flow rate and of average internal pressure of the steam. These regimes have a spontaneous and stable operation when the values are selected to the left of curve A in dashed lines on the diagram.

Figure 2:
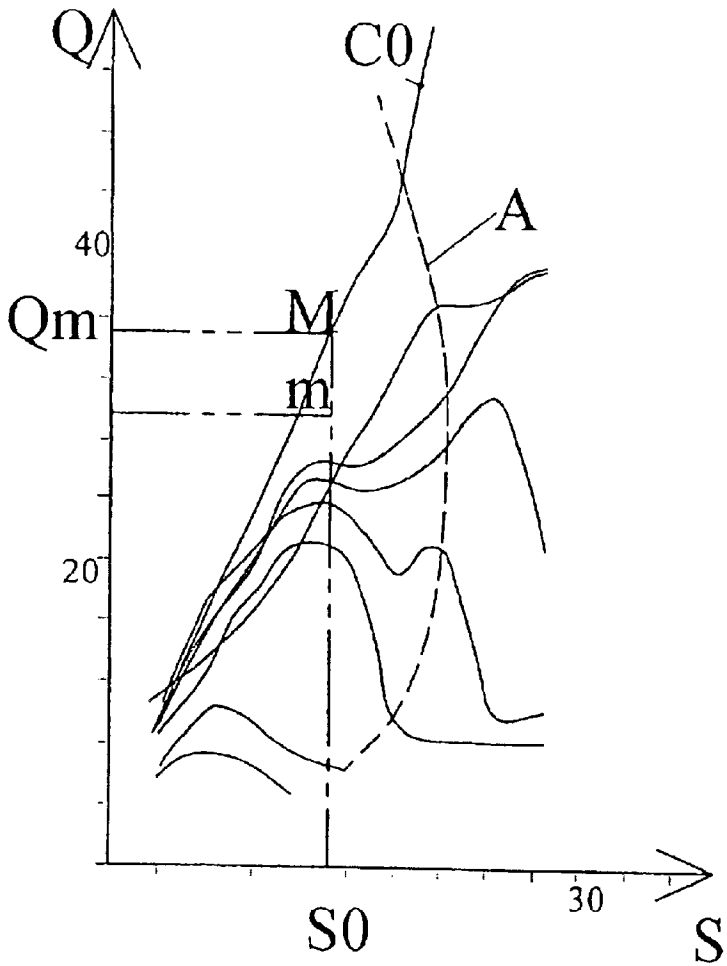
FIG. 2 is a diagram of the characteristic curves of the mass flow of steam of an iron according to the invention as a function of the steam outlet in the vicinity of the functioning of a constant steam outlet SO.

A choice is made of the maximum passage of orifice 9 of droplet device 8 corresponding, for example, to the curve CO of FIG. 2 and calibration of steam outlet 12 is chosen with a cross-section SO, referenced on the abscissa of FIG. 2. Point M then represents the operation where vaporization is maximum. The cross-section SO is selected in relation with curve CO in order for point M to be situated in the stability zone. In a concrete embodiment, given by way of non-limiting example of an iron having an installed power of 1900W, cross-section SO is chosen to be equal to 13 $mm^2$ and the droplet device has a maximum passage cross-section of 1.5 $mm^2$, spontaneous oscillatory operation being obtained in this structure for values of SO lower than 24 $mm^2$.

When the needle is closed and the water flow rate diminishes, the operating point m is displaced on the diagram of FIG. 2 while departing vertically from curve CO to approach the abscissa axis parallel to the ordinate axis. Cross-section SO is selected so that in this operation, the displacement of the operating point cuts a maximum number of the characteristic curves in the stability zone to permit a regulation without risk.

Under these conditions, when the iron is hot and the user places the steaming into operation, the steam is produced spontaneously in a pulsating regime the vibrations of which are not perceived. The steam generated at high pressure crosses the narrow outlet passages 12, in which the loss of load is very much greater than the loss of load that is created by ironing. The steam is emitted forcefully and passes easily through the materials, which renders ironing easier, or requires less steam for the same amount of work. This contributes to maintaining a healthy work environment.

Moreover, it is noted that the pressure variations prevent scale from being deposited on sensitive elements such as the valve plug and it becomes powdery for the most part. It is evacuated easily with the steam.

Figure 5:
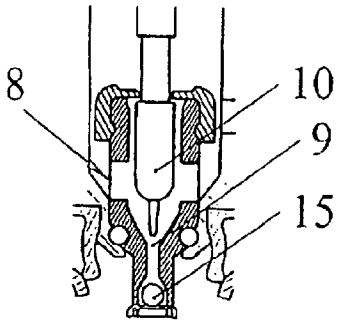
FIG. 5 is a cross-section showing the droplet supply and the valve of an iron according to a second version of the invention.

By this fact it was possible in a second version of the invention, to add an orifice valve for the admission of water as indicated in FIG. 5. The valve is, for example, constituted by a ball 15 disposed in a bore at the end of ajutage 9. Normally opened by the weight of the ball, the valve allows water to pass from reservoir 2 as long as the pressure in chamber 5 is low, and then closes.

Figure 6:
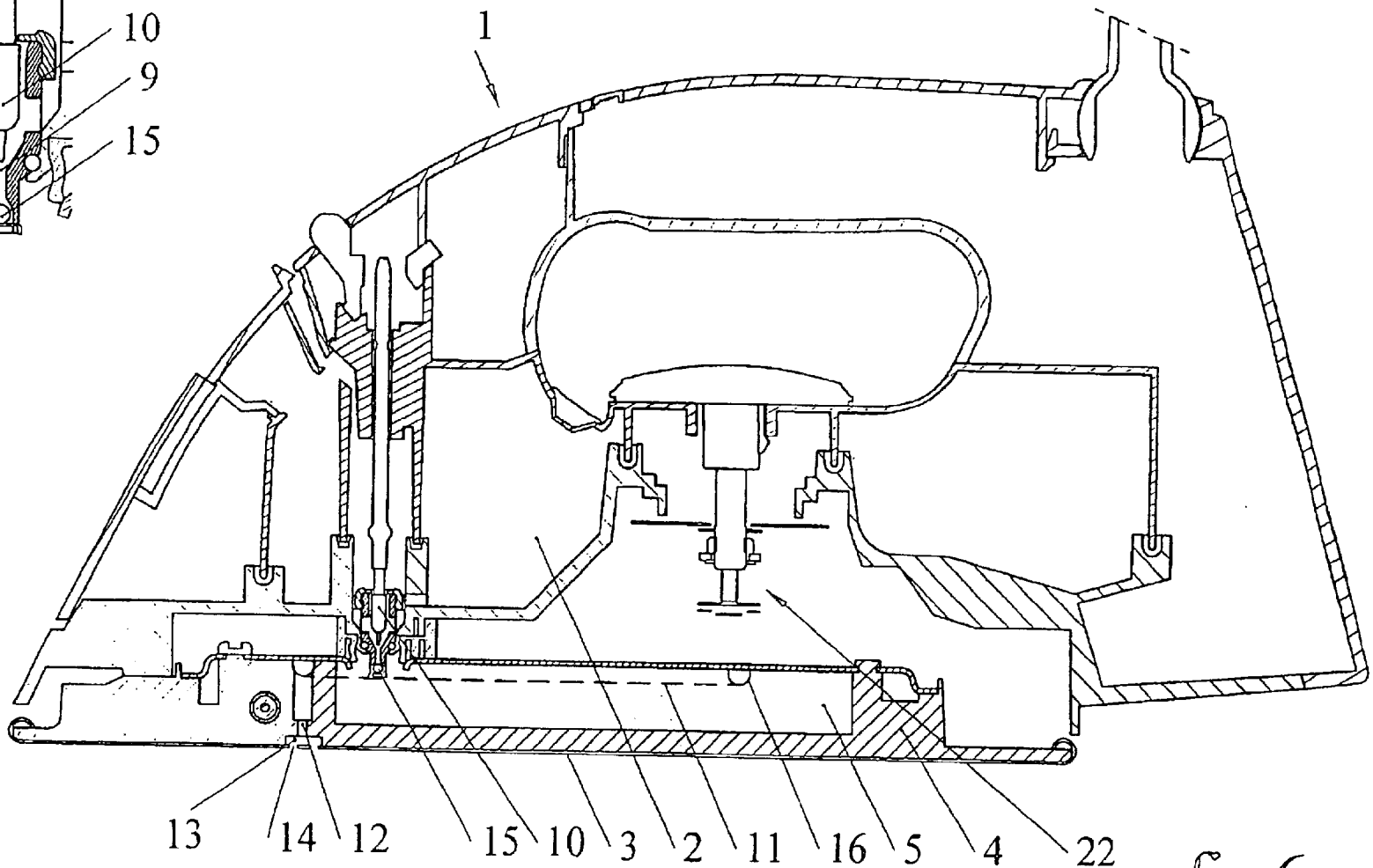
FIG. 6 is a longitudinal cross-sectional view of an iron according to a second version of the invention.
Figures 7, 8:
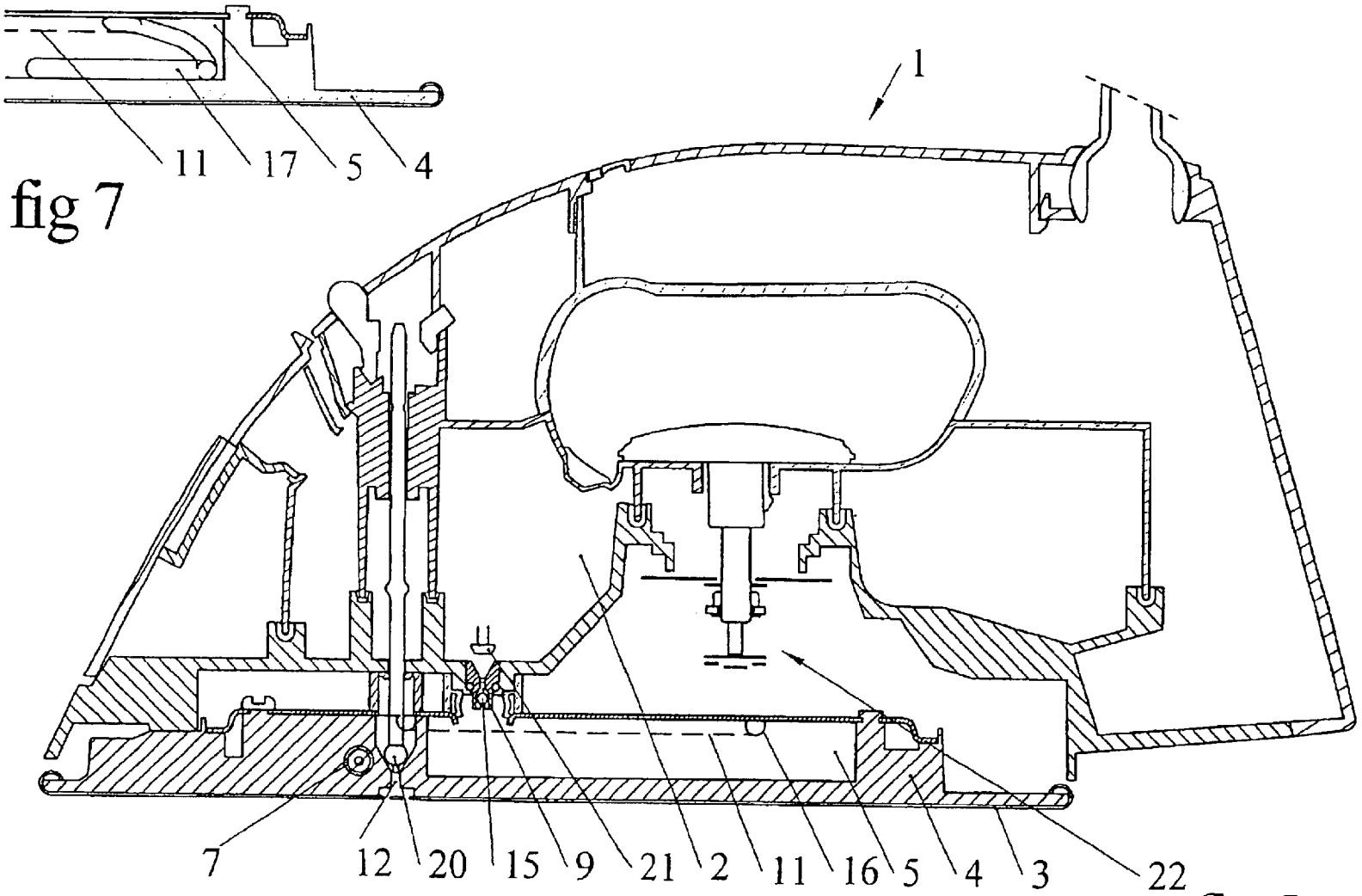
FIG. 7 is a longitudinal cross-sectional detail view of an iron according to a third version of the invention.
FIG. 8 is a longitudinal cross-sectional view of an iron according to a third version of the invention.

In an embodiment of this version represented in FIG. 6, channels 11 are elongated and calibrated with the same care as outlet orifices 12 in a manner such that the high displacement velocities involve more steam. At the end of evaporation of the water admitted preliminarily into the chamber, the system then has available more energy to create a pressure drop in chamber 5 and to open the valve. Channels 11 then have their inlet 16 spaced from the outlet by orifices 12. As needed, the length of channels 11 can even be increased for example by a coiled tube 17 having an inlet in chamber 5, as can be seen in FIG. 7.

It is noted that the operation has many similarities to the operation of the preceding version with the advantage that there are no reverse flows into the reservoir, which remains at a normal, ordinary temperature.

Figure 10:
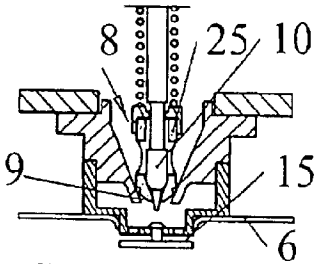
FIG. 10 is a cross-section showing the droplet supply and the valve of a variant of the invention.

In a preferred variant of the invention using a valve, the iron is an iron similar to that of FIG. 4 but equipped with a droplet device having a large passage and a valve 15, which are visible in FIG. 10. The steam outlet cross-section, marked SO on an equivalent of FIG. 2, is reduced only by the spontaneous triggering of oscillations obtained by an average opening of orifice 9 of the droplet device. Valve 15 made of silicone elastomer placed in series with the droplet device, is advantageously very light. It has a large surface, directed toward the steam chamber, on which the steam pressure can be applied to easily enclose it. The droplet device can, optionally, have a module 25 carrying orifice 9, said module being lifted at the end of the opening travel of pointer 10, in order to more rapidly liberate a larger passage for water from the reservoir. In a concrete form of construction, taken by way non-limiting example of an iron having an installed power of 1900 W, cross-section SO is chosen to be equal to 40 $mm^2$ and the droplet device has a maximum passage cross-section of 1.8 $mm^2$ when the module is on its seat, and of 25 $mm^2$ when the module is completely lifted. The oscillating operation is spontaneous for a steam passage cross section SO that can go up to 60 $mm^2$.

Figure 9:
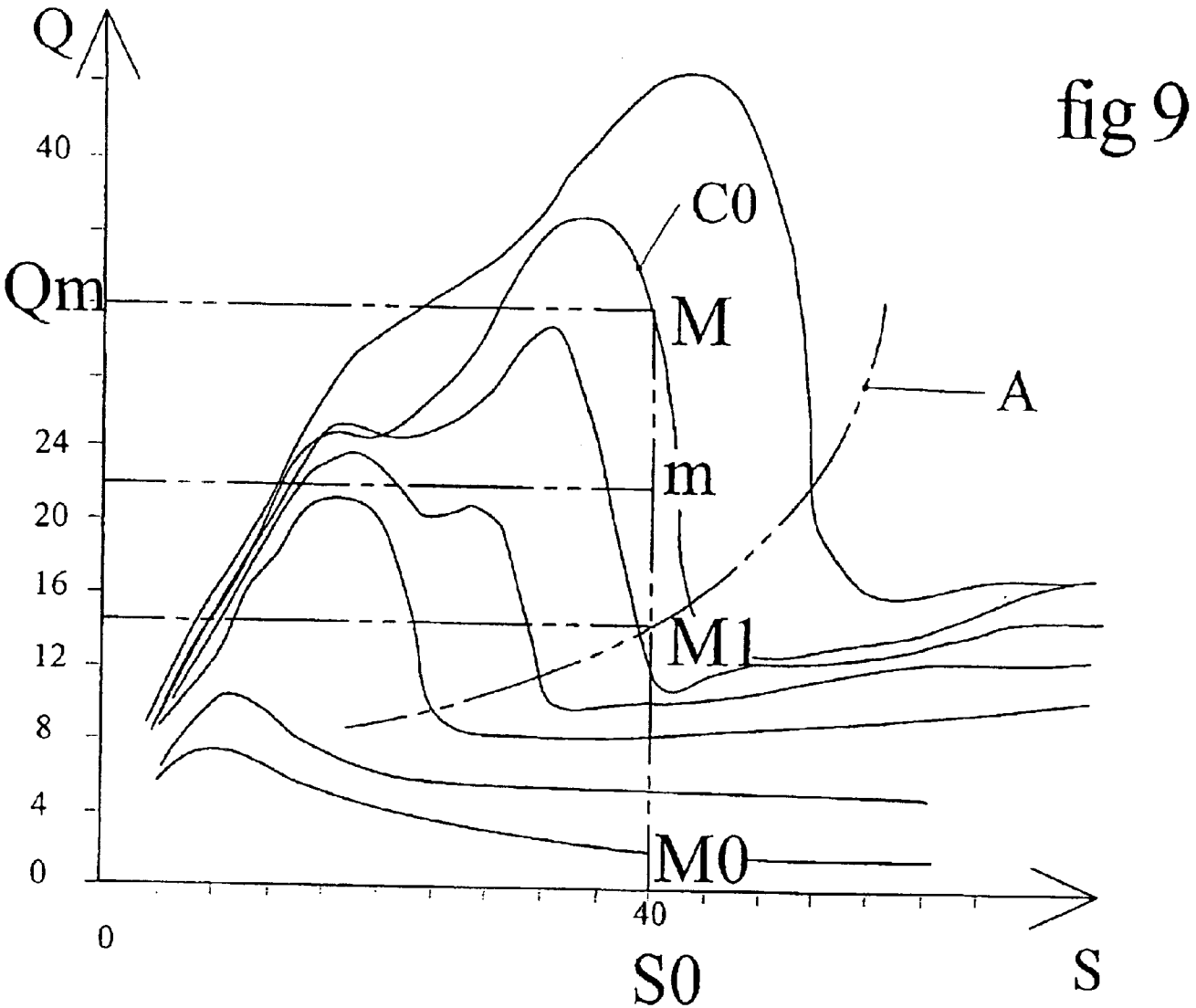
FIG. 9 is a diagram of the characteristic curves of a variant of an iron according to the invention showing the mass flow rate of steam as a function of the steam outlet.

For easy ironing, the user regulates the steam flow rate to a low level. On the diagram of FIG. 9, the operating point is situated between the points M0 and M1. The iron then functions in a conventional manner without pressure oscillations. When it is desired to iron difficult fabrics with a large amount of very energetic steam, the user increases the flow rate with the valve plug control. The iron then undergoes a change in regime, the operating point m crosses the limit line of stability and automatic triggering A to point M1, and is located between points M1 and M of the diagram of FIG. 9. The maximum operating point m is situated at M on curve CO corresponding to the maximum opening of the valve orifice. The iron functions with oscillations having a frequency of the order of 20 to 30 pulsations per minute for a prototype that was produced. The steam exiting at high velocity is highly penetrating and effective. The prototype, thus equipped with a large water inlet orifice and a valve, supplies 35 grams of steam per minute when the iron is lifted, and even 32 grams per minute when it is applied on the material to be ironed. The steam flow rate thus varies very little with ironing conditions.

A third version of the invention visible in FIG. 8, derived from the variant using a valve shown in FIG. 6, uses a passage of water from the reservoir into chamber 5 through a calibrated orifice 9 provided with a valve having a ball 15. But the ajutage thus constituted does not include a member for regulating the water flow rate. The steam circuit is provided with a steam flow rate regulation 20 constituted for example by a needle or by a plug acting at the junction of channels 11 with orifices 12.

Figure 3:
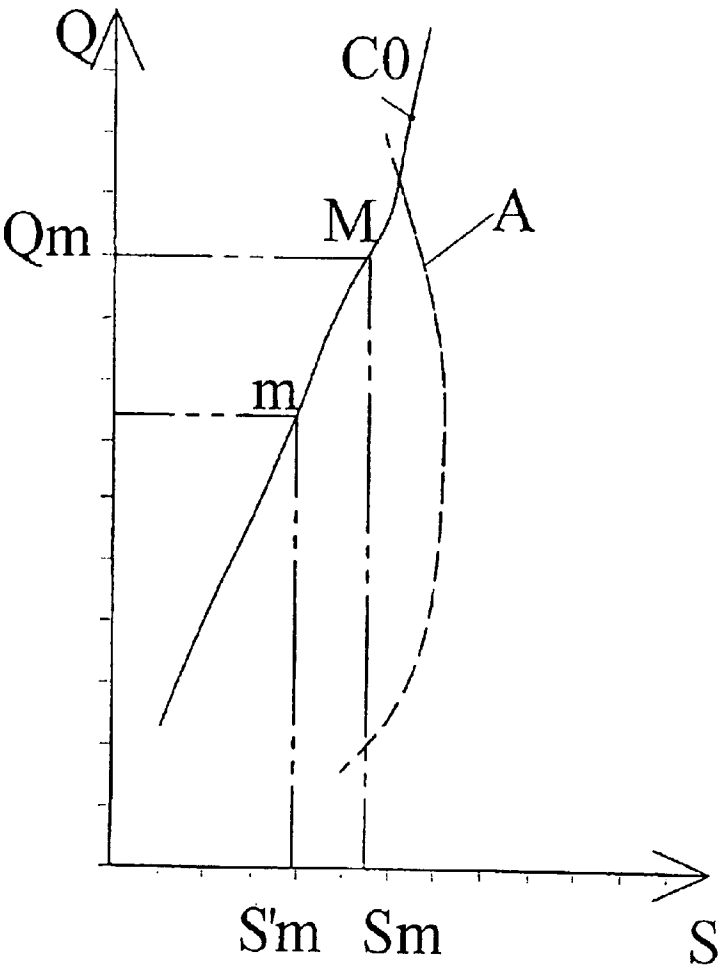
FIG. 3 is the diagram of the characteristic curve of the mass flow of steam of an iron according to the invention having a maximum and constant water admission passage as well as a variable steam outlet cross-section.

The passage of water in orifice 9 being constant, use is made of one of the characteristic curves similar to those previously described, for example the curve CO of FIG. 3 corresponding to the maximum of possibilities of vaporization. The regulating device 20 being fully open, it corresponds to the point Sm of the characteristic of the outlet and to the point M of operation. Channels 11 are calibrated so that this operating point at full power is situated in the stability zone.

When the regulating device closes the outlet, the point S' m approaches the abscissa origin and the operating point m follows the curve CO with a corresponding steam flow rate, while approaching the origins of the diagram. In tests performed, curve A delimiting the zone of stability is concave toward the origins, also this variant of realization of the invention gives more precision and oscillatory operating stability at small flow rates, at the price of an arrangement that is hardly more complex. To this construction one can also add a valve 21 to close the water passage toward chamber 5 when the user wants to perform dry ironing.

Regardless of the version, steam exits with sufficient force to be able to be used in a sprayer. It is sufficient for this to direct the steam outlet by a switch toward a sprayer rather than toward the steam distribution chamber 13.

Numerous variants can be conceived without departing from the framework of the invention. One could, for example, use an element for regulation of the steam flow rate in the first version described. One could also without difficulty adapt the invention to soleplates and steam chambers different from those that are illustrated, inter alia the adaptation can relate to irons having several heating elements.

What is claimed is:

1. Pressing iron (1) having a water reservoir (2) at atmospheric pressure, water from the reservoir flowing through an ajutage between this reservoir (2) and a heated and regulated steam chamber (5), a soleplate (3) having the ironing surface, steam outlet holes (12) being d arranged in the soleplate (3), characterized in that the iron (1) comprises means placing the water and steam circuit in resonance or relaxation vibration, the cyclic variation of the steam pressure being automatically maintained at an average pressure above that corresponding to the column of water available in the iron.

2. Pressing iron according to claim 1 characterized in that the steam outlet holes (12) and the diameter of the passage (9) of the valve (8) are adjusted in such a manner that an oscillatory regime is spontaneously obtained.

3. Pressing iron according to claim 1 characterized in that the ajutage is constituted by the passage (9) of a valve (8) having an adjustable flow rate.

4. Pressing iron according to claim 2 characterized in that the iron (1) has a one-way valve (15, 9) between the reservoir (2) and the steam chamber (5).

5. Pressing iron according to claim 4 characterized in that the steam circuit has elongated passages (11), where the steam circulates at high velocity, which constitute with the valve (15, 9) and the steam chamber (5) a spontaneously oscillating and stable steam circuit.

6. Pressing iron according to claim 4 characterized in that the iron has a regime of operation without oscillations and a regime of oscillating operation.

7. Pressing iron according to claim 1, characterized in that the iron comprises a valve having a fixed passage (9) acting as the ajutage between the reservoir (2) and the steam chamber (5).

8. Pressing iron according to claim 7 characterized in that it comprises in addition a valve (20) for regulating the flow rate of steam situated in the steam circuit.

9. Pressing iron according to claim 8 characterized in that the steam circuit has elongated passages (11), where the steam circulates at high velocity, which constitute with the valve and the steam chamber (5) a spontaneously oscillating and stable steam circuit.

* * * * *